US006272990B1

(12) United States Patent
Iwahashi et al.

(10) Patent No.: US 6,272,990 B1
(45) Date of Patent: Aug. 14, 2001

(54) AUTOMATIC DECELERATION AND STOPPAGE CONTROLLER FOR ROTARY PRESS

(75) Inventors: Yoshihiro Iwahashi, Kawasaki; Sadayu Kase, Yokosuka; Ryuichi Satoh; Tomohiro Takahashi, both of Kawasaki, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/669,716

(22) Filed: Sep. 26, 2000

(30) Foreign Application Priority Data

Feb. 10, 2000 (JP) ..... 12-033546

(51) Int. Cl.[7] ..... B41F 1/54; B41F 3/58
(52) U.S. Cl. ..... 101/484; 101/248; 101/483
(58) Field of Search ..... 101/484, 483, 101/226–232, 248

(56) References Cited

FOREIGN PATENT DOCUMENTS 64-30236 2/1989 (JP) .

64-85761 3/1989 (JP) .

*Primary Examiner*—John S. Hilten
*Assistant Examiner*—Charles H. Nolan, Jr.
(74) *Attorney, Agent, or Firm*—Armstrong, Westerman, Hattori, McLeland & Naughton, LLP

(57) ABSTRACT

An automatic deceleration and stoppage controller for a rotary press includes an input unit, a detection unit, a copy-number management unit, a printing-speed detection unit, and a processing unit. The input unit inputs a scheduled copy number indicating the number of signatures to be printed by and discharged from the rotary press. The detection unit detects the signatures discharged from the rotary press and outputs detection signals corresponding to the signatures. The copy-number management stores the scheduled copy number, subtracts from the scheduled copy number the total number of the detection signals successively output from the detection unit to thereby calculate a remaining copy number, and outputs a remaining-copy-number signal representing the remaining copy number. The printing-speed detection unit detects the operation speed of the rotary press and outputs an operation-speed signal representing the operation speed during printing. The processing unit calculates a period of time before completion of printing, and on the basis of the period of time, outputs an automatic deceleration and stoppage command signal for automatically decelerating and stopping the rotary press.

2 Claims, 4 Drawing Sheets

AUTOMATIC DECELERATION AND STOPPAGE CONTROLLER FOR ROTARY PRESS

BACKGROUND OF THE INVENTION

1. Field of the Invention

The present invention relates to an automatic deceleration and stoppage controller for a rotary press which can automatically decelerate and stop a rotary press after completion of printing of a scheduled number of copies.

2. Description of the Related Art

The complete specification of Japanese Utility Model Application Laid-Open (kokai) No. 64-030236 discloses a conventional technique for stopping the printing operation of a printing machine or a rotary press upon completion of printing of a scheduled number of copies.

Specifically, the complete specification discloses a copy-number management apparatus used with a plurality of printing machines which print the same print and which is adapted to simultaneously stop the printing machines after a scheduled number of copies are printed. When the remaining number of prints to be printed (hereinafter simply referred to as a "remaining copy number") has reached to a predetermined value, a deceleration signal is output to the respective printing machines, and when the remaining copy number has reached to zero, a stop signal is output to the respective printing machines.

The complete specification of Japanese Utility Model Application Laid-Open No. 64-030236 describes that when the remaining copy number has attained a predetermined value, a deceleration signal is output to the respective printing machines. Although a calculation for obtaining the remaining copy number is disclosed in detail, with regard to the deceleration and stop signals the specification discloses neither means for outputting these signals nor steps for outputting these signals.

That is, the apparatus disclosed in the specification is adapted to inform an operator or a print controller of a remaining copy number, on the basis of which a deceleration operation is performed independently. In other words, the apparatus disclosed in the specification cannot decelerate and stop the printing machines in an automated manner.

Accordingly, the operation must perform a manual stop operation, which makes labor saving impossible. Further, when the timing of the stopping operation is improper, an excessive number of copies are printed, resulting in wasteful use of printing paper or insufficiency in the number of printed copies. This problem may be solved when the timing of starting deceleration is made earlier in order to prolong the period for low-speed printing. However, this raises a problem of an increased time for completing the printing work and a resultant decrease in operation efficiency.

SUMMARY OF THE INVENTION

An object of the present invention is to solve the above-described problems and to provide an automatic deceleration and stoppage controller for a printing machine or rotary press which can automatically stop the printing machine or rotary press after completion of printing of a desired number of copies without a decrease in operation efficiency and which can minimize the number of excessive printed copies.

The present invention provides an automatic deceleration and stoppage controller for a rotary press which uses a paper roll and in which paper wave which has undergone continuous printing in a printing unit is cut and folded into signatures, and the thus-produced signatures are discharged from the rotary press, the controller comprising: input means for inputting a scheduled copy number indicating the number of the signatures to be printed by and discharged from the rotary press; detection means for detecting the signatures discharged from the rotary press and for outputting detection signals corresponding to the signatures; copy-number management means connected to the input means and detection means for receiving the scheduled copy number from the input means and the detection signals from the detection means, the copy-number management means storing the scheduled copy number, subtracting from the scheduled copy number the total number of the detection signals successively output from the detection means to thereby calculate a remaining copy number, and outputting to processing means a remaining-copy-number signal representing the remaining copy number; printing-speed detection means for detecting the operation speed of the rotary press and for outputting an operation-speed signal representing the operation speed during printing; and processing means connected to the copy-number management means and the printing-speed detection means for receiving the remaining-copy-number signal output from the copy-number management means and the operation-speed signal output from the printing-speed detection means, the processing means calculating a period of time before completion of printing, and on the basis of the period of time, outputting an automatic deceleration and stoppage command signal for automatically decelerating and stopping the rotary press.

Preferably, the automatic deceleration and stoppage controller of the present invention further comprises transmission means connected to the processing means. The transmission means transmits to an operator information regarding the printing speed of the rotary press, the remaining copy number, and the time period before initiation of automatic deceleration and stoppage, which are output from the processing means.

The automatic deceleration and stoppage controller for a rotary press according to the present invention enables the rotary press to print a desired number of copies, while minimizing the number of excess copies, and to automatically decelerate and stop safely. In addition, the automatic deceleration and stoppage controller according to the present invention can maximize the operation efficiency of the rotary press.

Further, the remaining copy number and the printing time which is to elapse before initiation of the automatic deceleration and stoppage operation are constantly transmitted to the operator by means of a display unit or a warning unit. Therefore, the operator can grasp the progress of the work and improve work efficiency without unnecessary worry.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An automatic deceleration and stoppage controller for a rotary press according to an embodiment of the present invention will be described with reference to the drawings.

Figure 1:
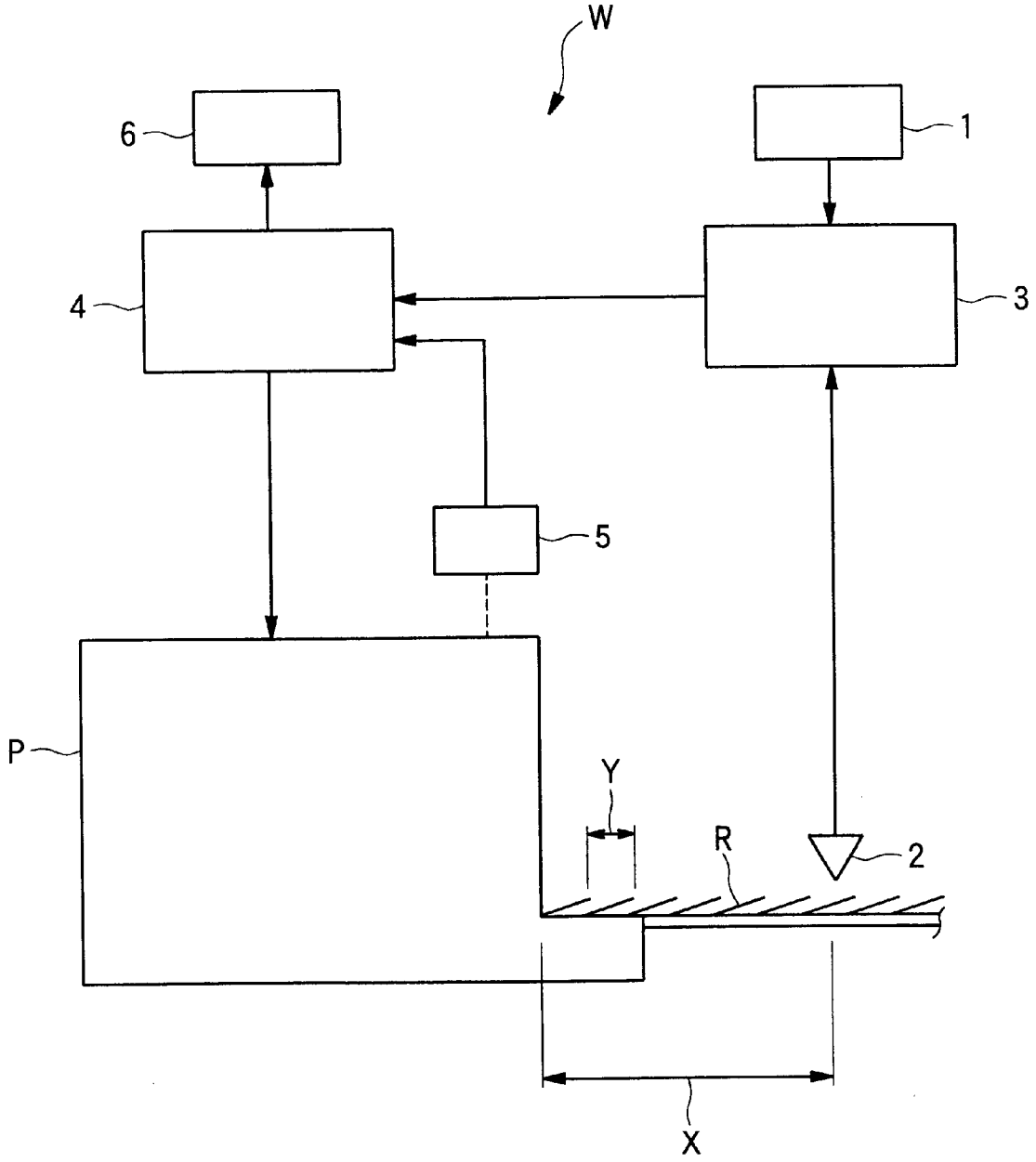
FIG. 1 is a block diagram showing the structure of an automatic deceleration and stoppage controller for a rotary press according to an embodiment of the present invention.

A rotary press P shown in FIG. 1 is configured in such a manner that paper web fed from an unillustrated paper roll is continuously printed in a printing unit; the printed paper is cut and folded in a folding unit into signatures R of a predetermined shape; and the thus-formed signatures R are discharged onto a conveyer.

An automatic deceleration and stoppage controller W comprises input means 1, detection means 2, copy-number management means 3, processing means 4, printing-speed detection means 5, and transmission means 6. The input means 1 is connected to the copy-number management means 3 and adapted to input thereto a scheduled copy number indicating the number of the signatures R to be printed by and discharged from the rotary press P. The detection means 2 is connected to the copy-number management means 3 and adapted to detect the signatures R discharged from the rotary press P and output to the copy-number management means 3 detection signals corresponding to the signatures. The copy-number management means 3 stores the scheduled copy number output from the input means 1; subtracts from the scheduled copy number the total number of the detection signals successively output from the detection means 2 to thereby calculate a remaining copy number; and outputs to processing means 4 a remaining-copy-number signal representing the remaining copy number. The printing-speed detection means 5 is connected to the processing means 4 and adapted to detect the operation speed of the rotary press P and output to the processing means 4 an operation-speed signal representing the operation speed during printing. The processing means 4 receives the remaining-copy-number signal output from the copy-number management means 3 and the operation-speed signal output from the printing-speed detection means 5; calculates a period of time before completion of printing; and on the basis of the period of time, outputs an automatic deceleration and stoppage command signal for automatically decelerating and stopping the rotary press P. The transmission means 6 is connected to the processing means 4 in order to receive therefrom a printing speed signal obtained from the operation-speed signal input to the processing means 4, the remaining-copy-number signal, and a signal representing the period of time before completion of printing calculated by the processing means 4. The processing means 4 is equipped with at least one of display means and warning means for providing an operator with information produced on the basis of the signals.

Next, the structural elements of the automatic deceleration and stoppage controller W will be described in more detail.

(1) Input Means 1:

The input means 1 is used to input a scheduled copy number to the copy-number management means 3. Before starting printing, an operator inputs a scheduled copy number to the copy-number management means 3 by use of the input means 1. The scheduled copy number indicates the number of signatures to be printed.

(2) Detection Means 2:

The detection means 2 detects each of the signatures R which have undergone printing in the rotary press P and are successively discharged from the folding unit to the conveyer. The detection means 2 successively outputs detection signals to the copy-number management means 3 during the period between the start of detection signal output and the end of detection signal output, which will be described below. The detection means 2 is disposed at a position downstream of the folding unit of the rotary press P.

(a) Start of detection signal output:

When the operation of the rotary press P is started, a low-speed printing operation is performed for a predetermined period, during which the operator performs print check work; i.e., the operator picks up some of the discharged signatures R and checks the printing quality. When the operator has confirmed that the printing quality is satisfactory, the operator turns on an unillustrated printing-speed increasing button provided on the rotary press in order to start the main printing operation. As a result, the printing speed of the rotary press P is increased to an appropriate printing speed.

When the printing-speed increasing button is turned on, the detection means 2 is enabled to start its operation for detecting the signatures R successively output from the rotary press P and for outputting detection signals corresponding thereto.

(b) End of detection signal output:

After the printing speed of the rotary press P has been increased upon initiation of the main printing operation, the printing operation is continued at a proper printing speed, and at the end of the printing operation, the printing speed is decreased for preparation of stoppage. When the printing speed is decreased to a predetermined low level, a sequential off operation is performed in order to stop supply of ink to a form plate of an unillustrated printing unit of the rotary press P, for the reason which described below.

When the sequential off operation is started, the detection means 2 is disabled so as to stop the output of the detection signals, which are generated upon detection of the signatures R successively discharged from the rotary press P.

When the deceleration of the rotary press P proceeds and the printing speed becomes lower than a certain level, paper is attracted by the plate cylinder due to stickiness of ink supplied to the form plate, with the result that poor printing, paper breakage, and other problems may occur. The sequential off operation is performed in order to prevent the above-described problem and to prevent unnecessary ink from remaining on the surface of the form plate upon stoppage of the rotary press, to thereby facilitate cleaning after the printing operation.

(3) Copy-number Management Means 3:

The copy-number management means 3 stores the scheduled copy number output from the input means 1. When the detection means 2 starts output of the detection signal, every time the detection signal is input, the copy-number management means subtracts "1" from the stored scheduled copy number in order to calculate a remaining copy number, and at each time outputs to the processing means 4 a remaining-copy-number signal representing the remaining copy number.

When the detection means 2 is disposed to detect the signatures R at a position which is located on the downstream side of and separated a distance X from the end of the rotary press P from which the signatures R are discharged, the copy-number management means 3 calculates the number of signatures R present over the distance X, on the basis of the distance X and a discharge pitch Y of the signatures R, which are set in advance, and stores the calculated number. The copy-number management means 3 subtracts the calculated number from the scheduled copy number output from the input means 1, in order to obtain a corrected scheduled copy number, and thereafter stores it. The copy-number management means 3 calculates the remaining copy number on the basis of the corrected scheduled copy number.

(4) Printing-speed Detection Means 5:

The printing-speed detection means 5 is a pulse generator or a tachometer generator connected to an unillustrated drive system of the rotary press P. The printing-speed detection means 5 detects the number of revolutions of the drive system per unit time and inputs to the processing means 4 a signal proportional to the number of revolutions of, for example, the plate cylinder, per unit time.

(5) Processing Means 4:

The number of copies printed during each revolution of the drive system of the rotary press P is input and set into the processing means 4. On the basis of the set value and the signal successively output from the printing-speed detection means 5 and representing the number of revolutions per unit time, the processing means 4 calculates a number of copies printed per unit time, every time the processing means 4 receives the signal. The thus-calculated number is treated as a printing speed S.

On the basis of the printing speed S (number of copies printed per unit time) and the remaining-copy-number signal output from the copy-number management means 3, the processing means 4 calculates, by use of a preset calculation formula, a time period that will elapse before issuance of a command signal for automatically decelerating and stopping the rotary press P. When the calculated time period has elapsed, the processing means 4 outputs the automatic deceleration and stoppage command signal.

The calculation in the processing means 4 is performed as follows.

Figure 3:
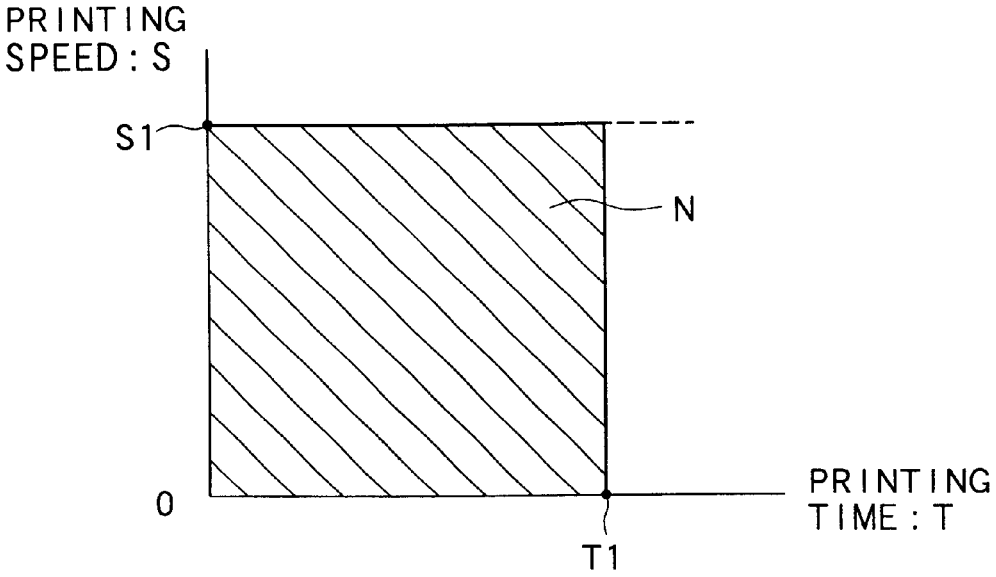
FIG. 3 is a graph showing a number of copies printed by a rotary press which is operated at a certain printing speed, wherein the vertical axis represents the printing speed of the rotary press and the horizontal axis represents elapse of time during the printing operation.

The number N of copies actually printed (hereinafter referred to as the "printing copy number") can be obtained as a product of the printing speed S and the printing time T. That is, as shown in the graph of FIG. 3, the printing copy number N for the main printing operation in which the rotary press P is operated at a printing speed S1 for a printing time T1 can be obtained through the following calculation:

Printing copy number N
= Printing speed S1 × Printing time T1.

The thus-calculated value corresponds to the area of a hatched portion.

Even after deceleration from the printing speed S1 has been started, the printing is continued, so that the printing is performed properly before the sequential off operation is started.

An effective copy number Ns indicating the number of copies properly printed during the deceleration is the difference obtained through subtraction of a defect copy number N2 from a total copy number N1, where the total copy number N1 represents the total number of copies printed during a period between start of the deceleration from the printing speed and stoppage of printing, and the defect copy number N2 represents the number of defect copies produced after initiation of the sequential off operation at the printing speed S2.

Figure 4:
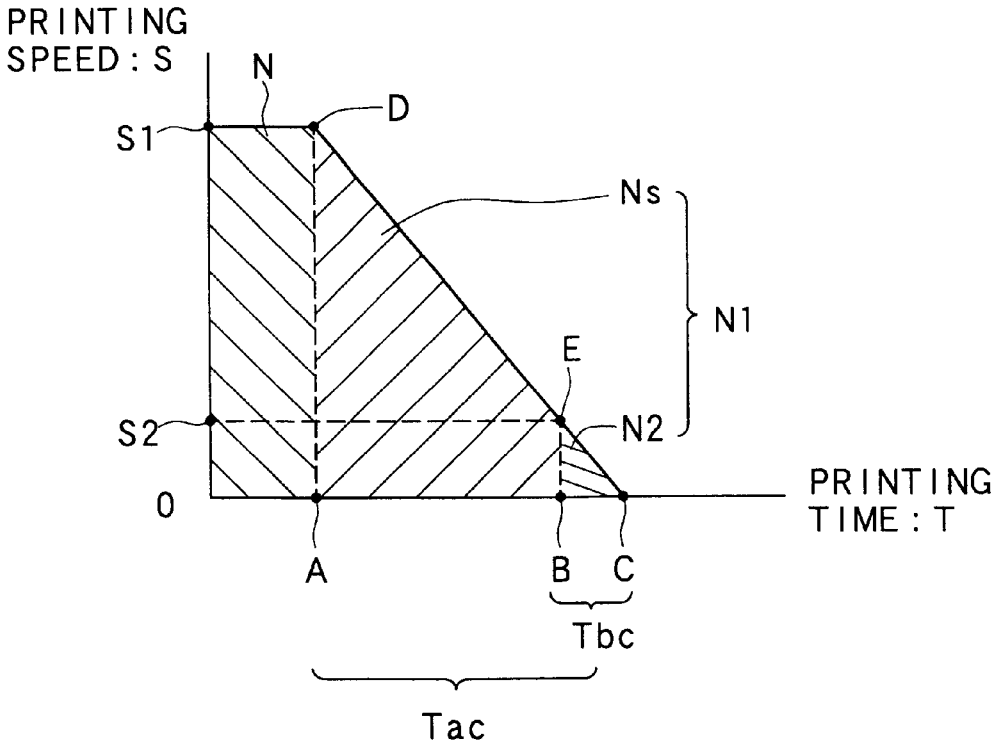
FIG. 4 is a graph showing a number of copies printed by a rotary press which is automatically decelerated from a certain printing speed, wherein the vertical axis represents the printing speed of the rotary press, and the horizontal axis represents elapse of time during the printing operation.

That is, for the case shown in FIG. 4, in which the deceleration from the printing seed S1 is started at time A, the sequential off operation is performed at time B, and the rotary press P is stopped at time C, the total copy number N1 representing the total number of copies printed during the automatic deceleration corresponds to the area of a triangle ACD in FIG. 4 and can be obtained by the following equation:

Total copy number N1=Printing speed S1 before initiation of deceleration×Printing time Tac between initiation of automatic declaration and stoppage×(½).

In contrast, the defect copy number N2 representing the number of defect copies produced between initiation of the sequential off operation and stoppage of the rotary press corresponds to the area of a triangle BCE in FIG. 4 and can be obtained by the following equation:

Defect copy number N2=Printing speed S2 at the time of initiation of the sequential off operation×Printing time Tbc between initiation of the sequential off operation and stoppage×(½).

The degree of deceleration caused by the automatic declaration between the position (corresponding to a coordinate position D) at the start of deceleration and the position (corresponding to a coordinate position E) at the stoppage; i.e., the slope of a line DC in FIG. 4, is set in advance to a constant value which is determined on the basis of the performance of the rotary press P such that even when the rotary press P decelerates from a high printing speed and stops, no excessive force acts on the machine and neither breakage nor failure occurs.

Accordingly, the effective copy number Ns can be obtained as follows.

(1) First, the printing speed S1 at the time of initiation of the automatic deceleration and the printing time Tac between initiation of the automatic deceleration and stoppage have the following relationship:

$$Tac = F \times S1$$

where F is a constant representing the rate of deceleration of the rotary press P.

(2) The total copy number N1 for the automatic deceleration period (the area of the triangle ACD) shown in FIG. 4 can be represented as follows:

$$N1 = S1 \times Tac \times (1/2)$$

$$= S1^2 \times F/2 \text{ (because } Tac = F \times S1)$$

(3) The defect copy number N2 for the automatic deceleration period (the area of the triangle BCE) shown in FIG. 4 can be represented as follows:

$$N2 = S2 \times Tbc \times (1/2)$$

$$= S2^2 \times F/2 \text{ (because } Tbc = F \times S2)$$

Since the printing speed S2 at the time of initiation of the sequential off operation of the rotary press P is set in advance, the printing speed S2 is a constant, as in the case of the rate of deceleration F. Therefore, the defect copy number N2 for the automatic deceleration period is also a constant.

(4) The effective copy number Ns for the automatic deceleration period (the area of the trapezoid ABED) shown in FIG. 4 can be represented as follows:

$$Ns=N1-N2=(S1^2-S2^2)\times F/2$$

Since the F and S2 in the above equation are constants, the effective copy number Ns for the automatic deceleration period can be determined if the printing speed S1 at the time of initiation of the automatic deceleration is determined.

In view of the foregoing, the processing means 4—which receives information of the remaining copy number Nh from the copy-number management means 3 and information of the printing speed S1 from the printing-speed detection means 5—always calculates the time Ts that is to elapse before initiation of the automatic deceleration and stoppage, by the following equation:

$$Ts=(Nh-Ns)/S1$$

The time Ts before initiation of the automatic deceleration, the remaining copy number Nh, and the printing speed S1 are output, at an appropriate timing, to the transmission means 6, which will be described later, and are displayed on an unillustrated display unit of the transmission means 6.

The processing means 4 may be configured such that when the time Ts before initiation of the automatic deceleration becomes, for example, 1 minute, the processing means 4 outputs a signal to an unillustrated warning unit of the transmission means 6 in order to produce a warning sound.

When the time Ts before initiation of the automatic deceleration becomes 0 minutes, the processing means 4 outputs an automatic deceleration and stoppage command signal that instructs initiation of automatic deceleration and stoppage. Upon reception of this signal, the rotary press P starts an automatic deceleration operation.

(6) Transmission Means 6

The transmission means 6 is equipped with an unillustrated display unit and optionally with an unillustrated warning unit. The remaining copy number Nh output from the copy-number management means 3 via the processing means 4, as well as the printing speed S1 and the time Ts before initiation of the automatic deceleration and stoppage, both calculated by the processing means 4, are input to the transmission means 6, which always displays the remaining copy number Nh, the printing speed S1, and the time Ts before initiation of the automatic deceleration and stoppage. The warning unit produces a warning sound upon reception from the processing means 4 of a signal that indicates that the time Ts before initiation of the automatic deceleration and stoppage has decreased to, for example, 1 minute.

Figure 2A:
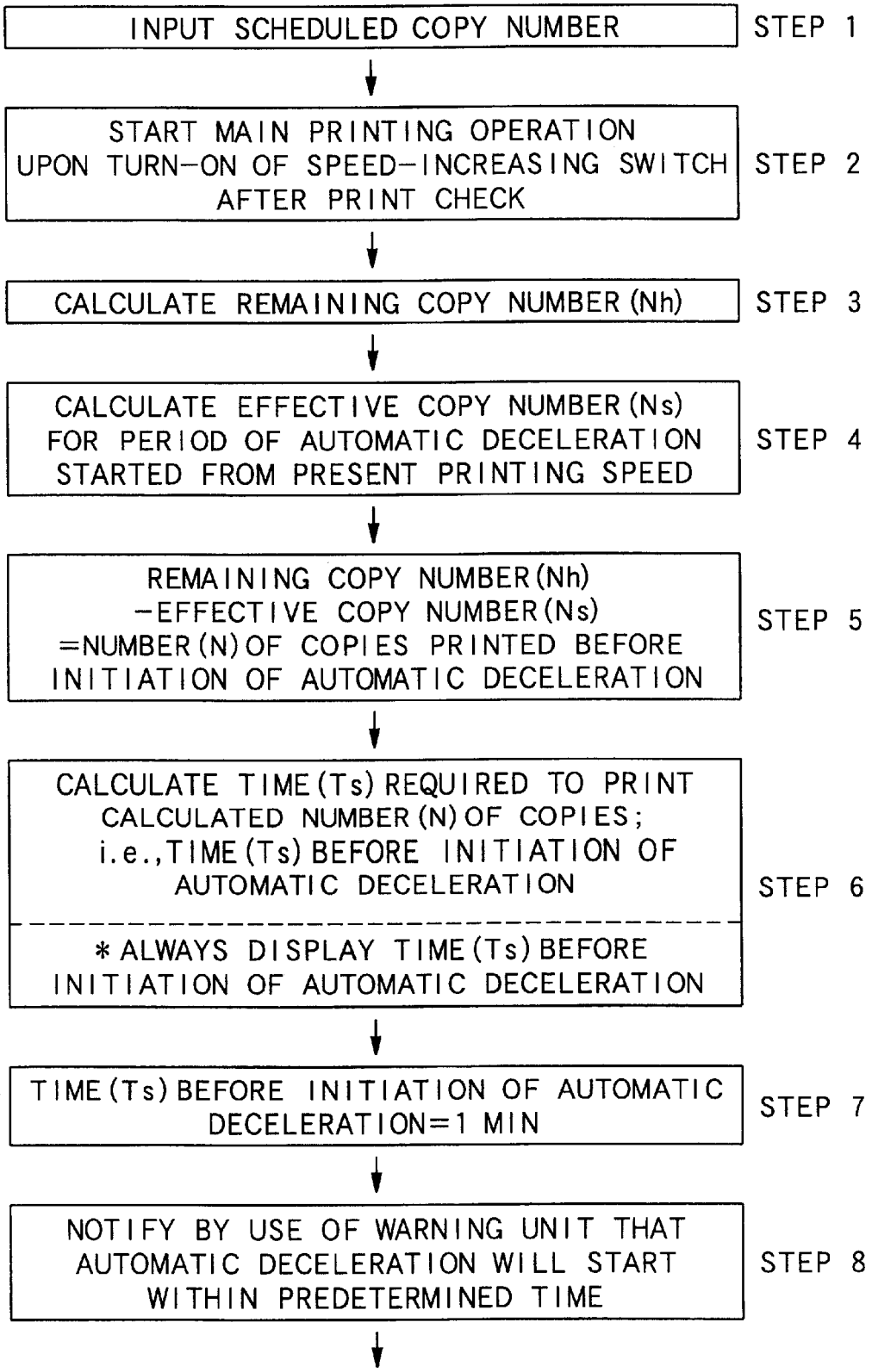
FIGS. 2A and 2B are flowcharts showing operation of the automatic deceleration and stoppage controller for a rotary press according to the embodiment of the present invention.
Figure 2B:
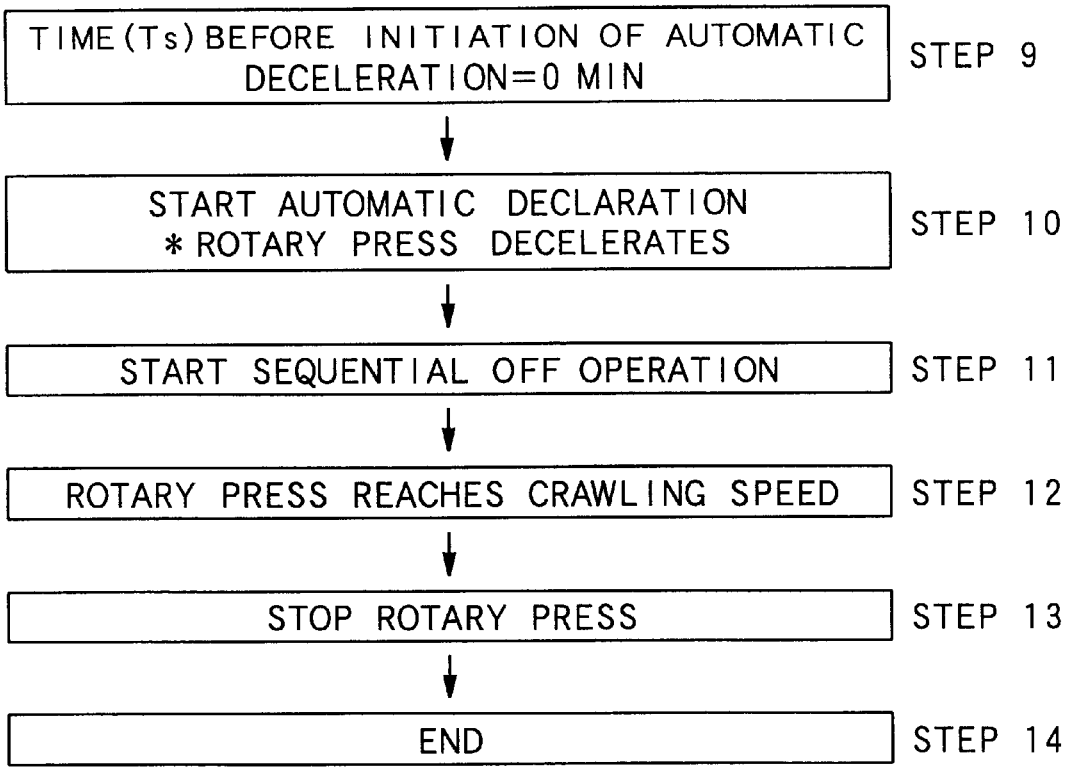

Next, the process of operation and action of the automatic deceleration and stoppage controller will be described with reference to FIGS. 2A and 2B (Step 1) An operator operates the input means 1 to enter data indicating a scheduled copy number to the copy-number management means 3.

(Step 2) The operator starts the rotary press P and checks signatures R discharged from the rotary press P. Subsequently, the printing speed of the rotary press P is increased, and simultaneously, a main printing operation is started at, for example, a printing speed S1. The printing-speed detection means 5 detects the rotational speed of the drive system of the rotary press P which performs printing. The thus-detected the rotational speed of the drive system of the rotary press P during printing is input to the processing means 4. The printed signatures are discharged from the rotary press P and are transported by transportation means.

(Step 3) The printed signatures transported by the transportation means are detected by the detection means 2, and the detection signals are successively input to the copy-number management means 3. Upon reception of each of the detection signals, the copy-number management means 3 decrements the scheduled copy number so as to calculate the remaining copy number (Nh) and outputs information of the remaining copy number (Nh) to the processing means 4.

(Step 4) On the basis of the rotational speed; i.e., the number of revolutions per unit time, of the drive system of the rotary press P during printing that is output from the printing-speed detection means 5, the Processing means 4 calculates the printing speed S; i.e., the number of copies printed per unit time. Further, on the basis of the printing speed S and the remaining copy number Nh output from the copy-number management means 3, the processing means 4 calculates the effective copy number Ns for the period of automatic deceleration which is started from the present printing speed S1.

(Step 5) The processing means 4 subtracts the effective copy number Ns for the period of automatic deceleration from the remaining copy number (Nh) so as to obtain a printing copy number (N) indicating the number of copies to be printed before initiation of automatic deceleration.

(Step 6) The processing means 4 calculates the time (Ts) required to print the calculated number (N) of copies; i.e., the time (Ts) that is to elapse before initiation of automatic deceleration.

(Step 7) The processing means 4 judges whether the time (Ts) has decreased to a predetermined time; e.g., 1 minute. When the time (Ts) has decreased to the predetermined time, the processing means 4 outputs to the transmission means 6 a signal to that effect.

(Step 8) Upon reception of the signal indicating that the time (Ts) has decreased to the predetermined time (1 min.), the transmission 6 causes the warning unit to provide a warning indicating that the automatic deceleration will start within the predetermined period of time.

(Step 9) When the time (Ts) has become zero, the processing means 4 outputs an automatic deceleration and stoppage command signal to the rotary press.

(Step 10) Upon reception of the automatic deceleration and stoppage command signal, the drive control unit of the rotary press starts automatic deceleration of the rotary press.

(Step 11) When the deceleration of the rotary press P proceeds and reaches the printing speed S2 for initiation of the sequential off operation, the remaining copy number becomes zero, so that the printing of a scheduled number of copies is completed, and the sequential off operation is started.

(Step 12) As a result of deceleration, the printing speed of the rotary press reaches a crawling speed, which is the lowest printing speed.

(Step 13) The operation of the rotary press is stopped.

(Step 14) Thus, the printing operation is completed, and signatures R discharged after initiation of the sequential off operation are removed by appropriate means; e.g., an operator.

Obviously, numerous modifications and variations of the present invention are possible in light of the above teachings. It is therefore to be understood that within the scope of the appended claims, the present invention may be practiced otherwise than as specifically described herein.

What is claimed is:

1. An automatic deceleration and stoppage controller for a rotary press which uses a paper roll and in which a paper wave which has undergone continuous printing in a printing unit is cut and folded into signatures, and the thus-produced signatures are discharged from the rotary press, the controller comprising:

input means for inputting a scheduled copy number indicating the number of the signatures to be printed by and discharged from the rotary press;

detection means for detecting the signatures discharged from the rotary press and for outputting detection signals corresponding to the signatures;

copy-number management means connected to the input means and detection means for receiving the scheduled copy number from the input means and the detection signals from the detection means, the copy-number management means storing the scheduled copy number, subtracting from the scheduled copy number the total number of the detection signals successively output from the detection means to thereby calculate a remaining copy number, and outputting a remaining-copy-number signal representing the remaining copy number;

printing-speed detection means for detecting an operation speed of the rotary press and for outputting an operation-speed signal representing the operation speed during printing; and processing means connected to the copy-number management means and the printing-speed detection means for receiving the remaining-copy-number signal output from the copy-number management means and the operation-speed signal output from the printing-speed detection means, the processing means calculating a period of time before completion of printing, and on the basis of the period of time, outputting an automatic deceleration and stoppage command signal for automatically decelerating and stopping the rotary press.

2. An automatic deceleration and stoppage controller according to claim 1, further comprising transmission means connected to the processing means, the transmission means transmitting to an operator information regarding the printing speed of the rotary press, the remaining copy number, and the time period before initiation of automatic deceleration and stoppage, which are output from the processing means.

* * * * *